US008707848B2

(12) United States Patent
Allor et al.

(10) Patent No.: US 8,707,848 B2
(45) Date of Patent: Apr. 29, 2014

(54) V-SHAPED BLAST SHIELD FOR PROTECTION AGAINST IEDS

(75) Inventors: Richard L. Allor, Livonia, MI (US); Thomas J. Husak, Roseville, MI (US); Dainius E. Skiotys, Farmington Hills, MI (US)

(73) Assignee: Ceradyne, Inc., Costa Mesa, CA (US)

( * ) Notice: Subject to any disclaimer, the term of this patent is extended or adjusted under 35 U.S.C. 154(b) by 287 days.

(21) Appl. No.: 12/928,061

(22) Filed: Dec. 1, 2010

(65) Prior Publication Data

US 2012/0255428 A1 Oct. 11, 2012

(51) Int. Cl.
*F41H 7/04* (2006.01)

(52) U.S. Cl.
USPC ..... 89/36.08; 89/36.01; 89/36.07; 89/36.09

(58) Field of Classification Search
USPC ..... 89/36.01, 36.07, 36.08, 36.09; 296/187.07; 52/837
See application file for complete search history.

(56) References Cited

U.S. PATENT DOCUMENTS

| | | | | |
|---|---|---|---|---|
| 4,351,558 | A * | 9/1982 | Mueller | 296/203.01 |
| 4,398,446 | A * | 8/1983 | Pagano et al. | 89/36.08 |
| 6,460,309 | B1 * | 10/2002 | Schneider | 52/837 |
| 2005/0031843 | A1 * | 2/2005 | Robinson et al. | 428/293.4 |
| 2007/0186762 | A1 * | 8/2007 | Dehart et al. | 89/36.09 |

* cited by examiner

*Primary Examiner* — Michael Carone
*Assistant Examiner* — Benjamin Gomberg
(74) *Attorney, Agent, or Firm* — C. Michael Geise

(57) ABSTRACT

An armor blast shield for use on the bottom of a vehicle to protect occupants of the vehicle from improvised explosive devices. A preferred embodiment is configured in a V-shaped configuration formed by at least two planar blast resistant panels and an I-beam having channels with inclined walls which receive the panels at an obtuse angle. The panels are adhesively adhered to the I-beam channel walls and at least one bolt is secured through the I-beam and a panel to provide superior blast resistant performance as compared to welded panels.

14 Claims, 5 Drawing Sheets

V-SHAPED BLAST SHIELD FOR PROTECTION AGAINST IEDS

BACKGROUND OF THE INVENTION

1. Field of the Invention

The present invention relates generally to the field of armor for the protection of passengers of a military vehicle. The invention relates more specifically to a blast shield for the bottom surface of military vehicles to protect passengers against IEDs.

2. Background Discussion

The wars in Iraq and Afghanistan have shown that our military vehicles need a re-design to the bottom of the vehicle to protect against the new threat of Improvised Explosive Devices (IEDs). One of the first "V" shaped blast hull designs was used by the South African military in the 1980's. It was specifically designed to maximize passenger survivability for conventionally laid mines. The V-shaped hull is designed to redirect the blast out and away from the vehicle's passenger area. The vehicle may be disabled by the IED, but passengers will survive the blast.

It is easy to design a new vehicle with V-shaped blast shield. All of the new MRAP vehicles, (Mine Resistant Ambush Protected) are equipped with a V-hull and most new military vehicles coming out today from all suppliers have them. A large problem is attaching the V-shaped blast shield to vehicles that are already in service. One such vehicle is the Humvee which rides close to the ground and has a flat bottom. There are over 16,000 armored Humvees in Iraq today with over 100,000 Humvees worldwide. Their flat, low bottom surface makes them vulnerable to the IEDs. Today the military is adding armor to the sides, but no blast protection is being added to the flat bottom of the vehicle.

SUMMARY OF INVENTION

In the present invention, a manufacturing process is implemented to build a V-shaped blast shield that could be attached to a vehicle bottom. This may be applied to a new vehicle or one that's already in service.

Tests were conducted to determine the best manufacturing process to be used when the V-hull was exposed to the mine blast forces. The investigation included Mig Welding, Friction Stir Welding (FSW) and adhesive bonding with bolts.

The following results were recorded; welding was compared to FSW on joining two blast shields together. The test results show that welding was the weakest method at about 83% below baseline and FSW was about 26% lower than the baseline samples. The baseline test uses a panel without any joining methods applied.

On a second set of test Mig Welding on two surfaces was compared to applying an adhesive to three (3) surfaces. In this test, a sample was fabricated for each method and then compression tested to failure. The adhesive joint was twice as strong as the welded samples. A retest with the welded sample was done to make sure of the data and the results were the same. It was noted that when the adhesive joint had failed, it was immediate, and there was no strength remaining in the joint. After seeing this, it was decided that the adhesive joint, along with a high strength bolt, was needed to survive the blast force. Also, a tapped blind bolt hole is a flat bottom hole used to prevent any secondary projectiles from entering the cabin. To form the V-shaped hull when using flat panels of blast resistant material, an I-beam is machined or extruded to form the needed V-hull with an I-beam. The I-beam channel opening is configured to have between 0.020-0.030" oversize to the thickness of the flat plates that are installed. The oversize is the receiver for the adhesive. The receiving channels in the I-beam for the flat blast plate have an obtuse angle between the plates that would allow the plates to clear the bottom of the vehicle to make the V-hull. Then, a number of threaded holes with flat bottoms are employed. The adhesive used was from ITW Plexus. Any adhesive with the same mechanical properties could be used. The blast plates used for this test were from Cellular Materials International (CMI) Microtruss™ Any blast plate material could be used with this invention. This manufacturing process could be used for new vehicles or as an upgrade to flat bottom vehicles.

Many blast shield materials may be limited in size. To overcome this, a coupler sleeve may be used to join parts together for adhesive joining. The same manufacturing method described above can be used to increase the width of the blast shield. The only difference is that the receiving channels in the I-beam, coupler sleeve, are at 90 degrees to the top and bottom surfaces.

The inventive structure was used to build a test blast shield and then tested in a blast. This test was successful where the glue joint stayed intact, and the I-beam did not fail during the blast and no secondary projectiles entered the cabin.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which.

DETAILED DESCRIPTION OF A PREFERRED EMBODIMENT

Figure 1:
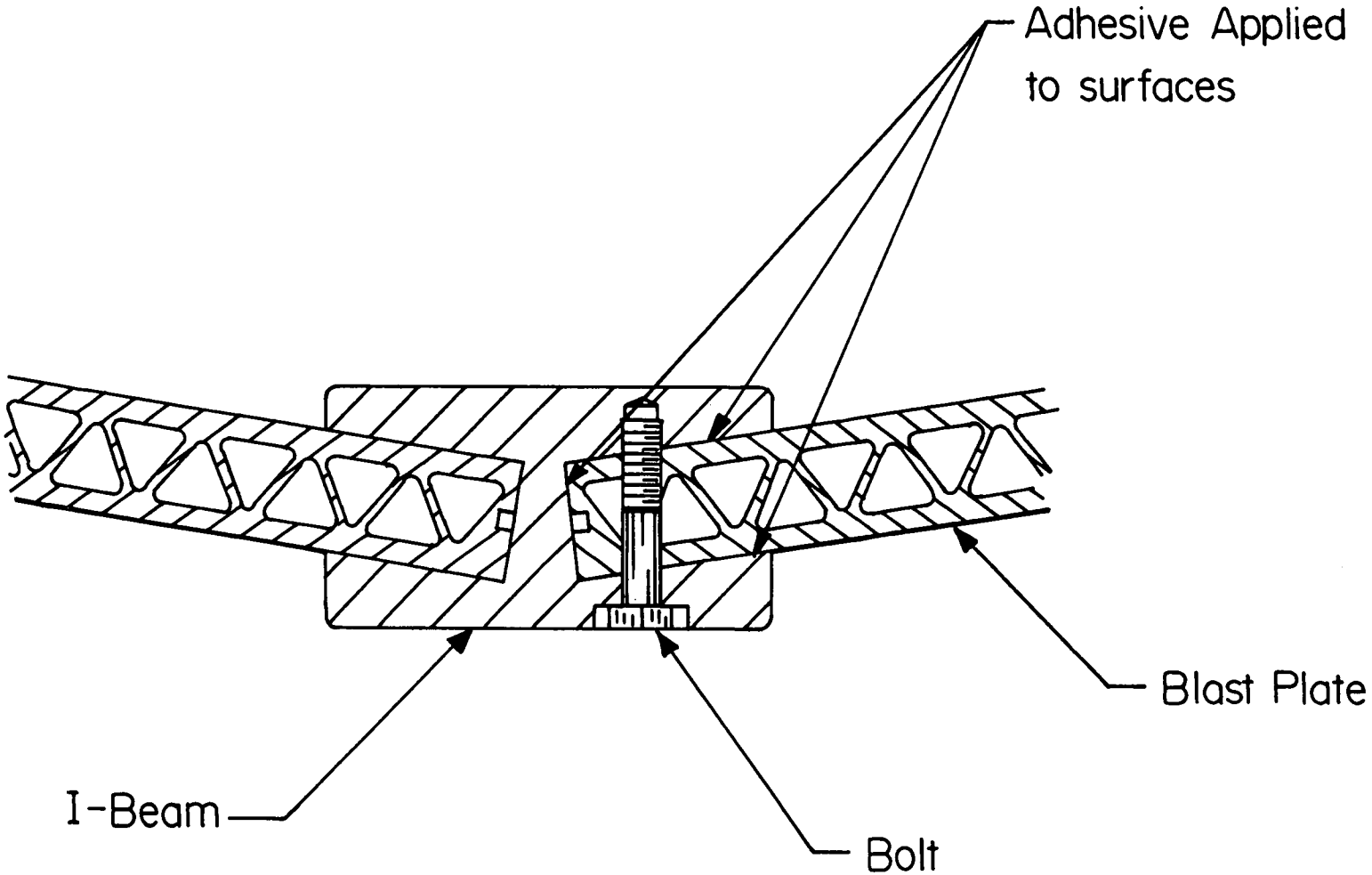
FIG. 1 is a cross-sectional view of a V-shaped armor blast shield showing the interconnection between angled blast plates and an I-beam.
Figure 2:
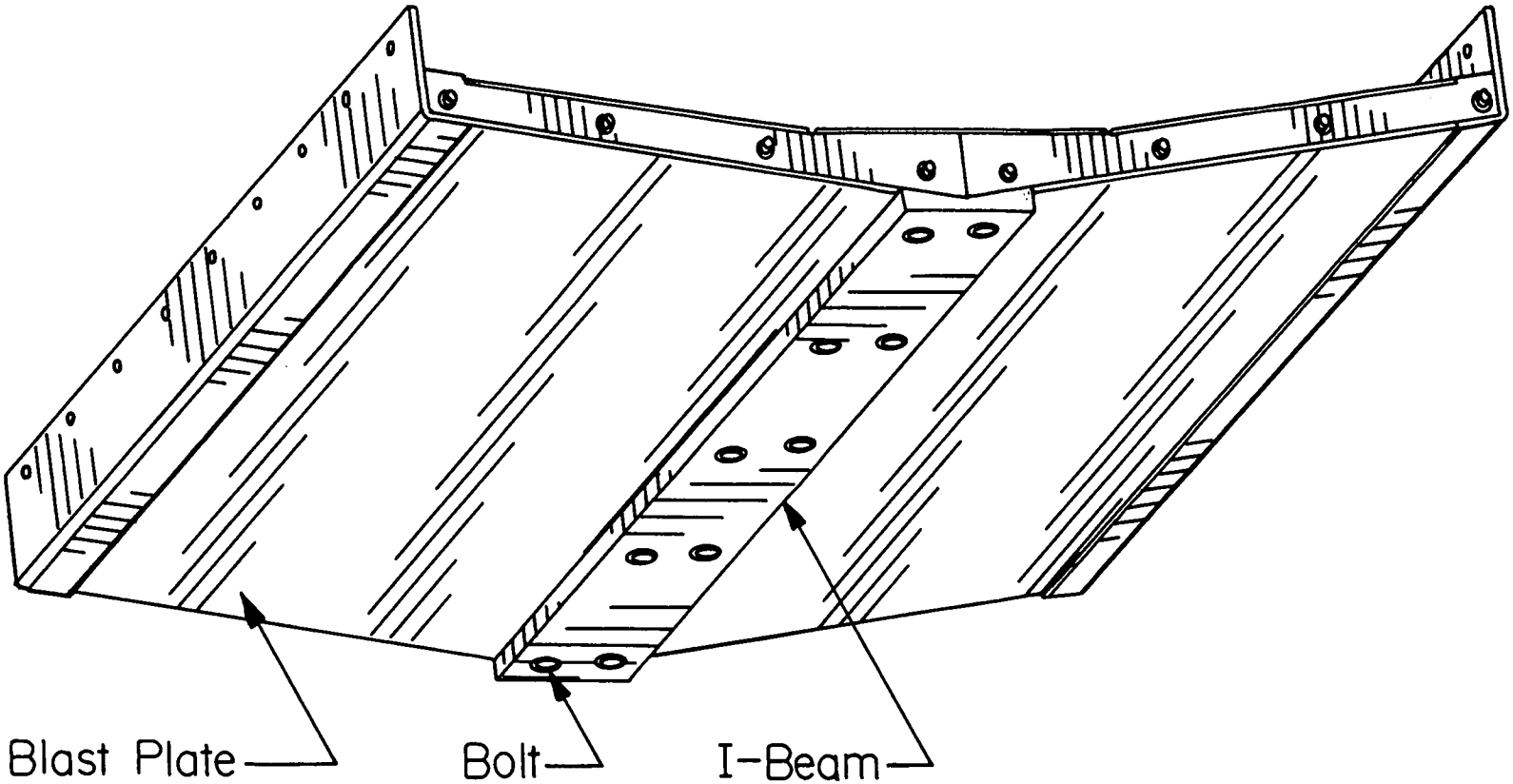
FIG. 2 is a three-dimensional bottom view of a blast shield in accordance with a preferred embodiment of the present invention.
Figure 3:
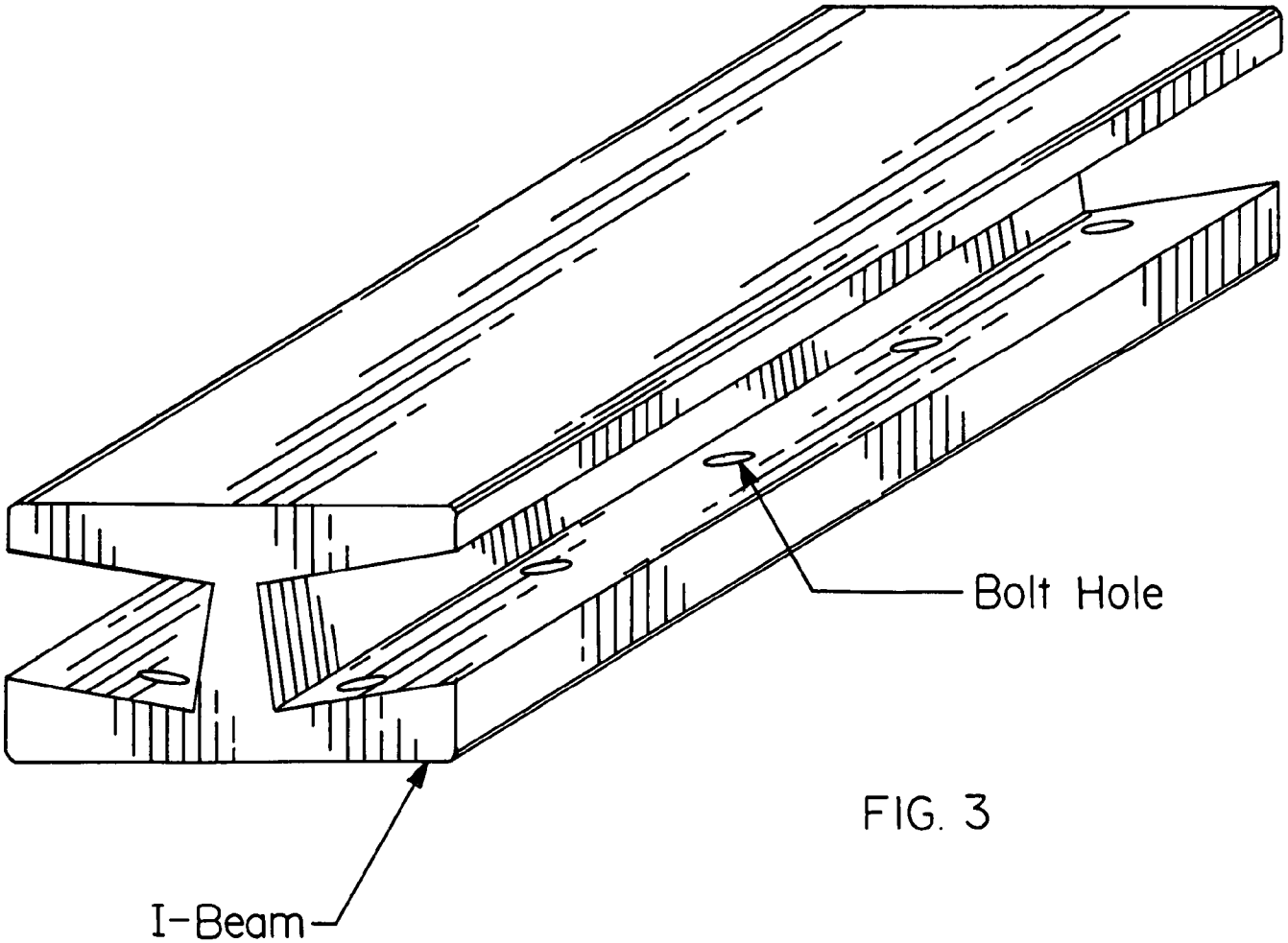
FIG. 3 is a three-dimensional view of an I-beam used in the preferred embodiment.

Referring to the accompanying figures and to FIGS. 1 through 3 in particular, it will be seen that in cross-section, a preferred embodiment of the present invention comprises at least a pair of opposed blast plates and an I-beam. As shown best in FIG. 3, the I-beam has a pair of channels formed from inclined walls, that is, walls that are not precisely parallel to the top and bottom of the I-beam. The blast plates are preferably planar panels that are specifically manufactured to withstand the energy of an explosively induced blast. In the illustrated embodiment, each blast plate is formed from Microtruss™ periodic cellular material made by Cellular Materials International, Inc. of Charlottesville, Va. from a 6063 aluminum by extrusion.

The invention herein relies in part on maintaining the loading integrity of these blast resistant panels by avoiding the use of welding and instead relying on adhesive to affix the panels into the channels of the I-beam. As shown schematically in FIG. 1, each blast plate has an adhesive applied to its mating surfaces that interface with the inclined walls of the I-beam channels. Then a bolt is placed in to the I-beam and through the plate where it extends into and entirely through a channel of the I-beam. FIG. 2 illustrates the entire V-shaped blast shield ready for installation below the hull of a vehicle and comprising a pair of planar blast resistant panels and an I-beam having inclined interior walls forming a pair of spaced parallel-opposed channels that receive the plates in a V-shaped relation. Each panel is adhesively affixed to a respective channel of the I-beam and is further secured therein by bolts extending through both the I-beam and the panel. The adhesive used to secure each panel into a channel of the I-beam may, by way of example, be a two-part (adhesive and activator) methacrylate adhesive manufacture by ITW Plexus of Danvers, Mass. under the name Plexus® MA832 and specifically designed for structural bonding of metals.

Figure 4:
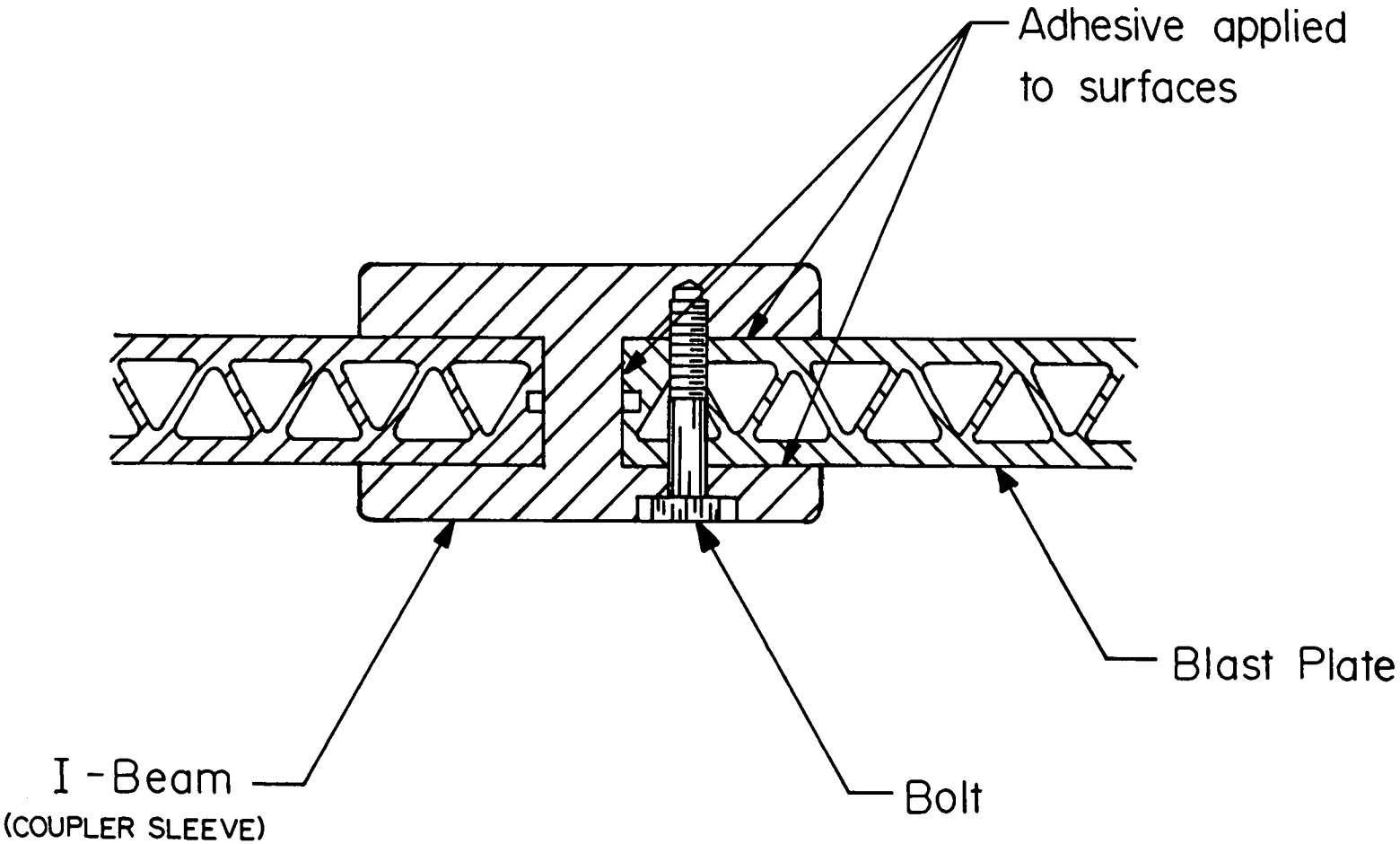
FIG. 4 is a cross-sectional view of an extension technique used to add to the width of a blast shield of FIGS. 1 and 2.

In those instances where the blast plates are not sufficiently wide to accommodate both the angle of the V-shape and the full width of a vehicle, the configuration of FIG. 4 may be implemented. As shown therein, the I-beam and blast plate interface in essentially the same way as show in FIG. 1 for the initial interconnection except that the channel walls of the I-beam are not inclined, but are parallel to the external I-beam surfaces. This permits the connection of additional blast plates or extensions without altering the original angle of the blast plates. However, the interconnection still relies on adhesive and a bolt interface to implement the panel/I-beam relation.

Figure 5:
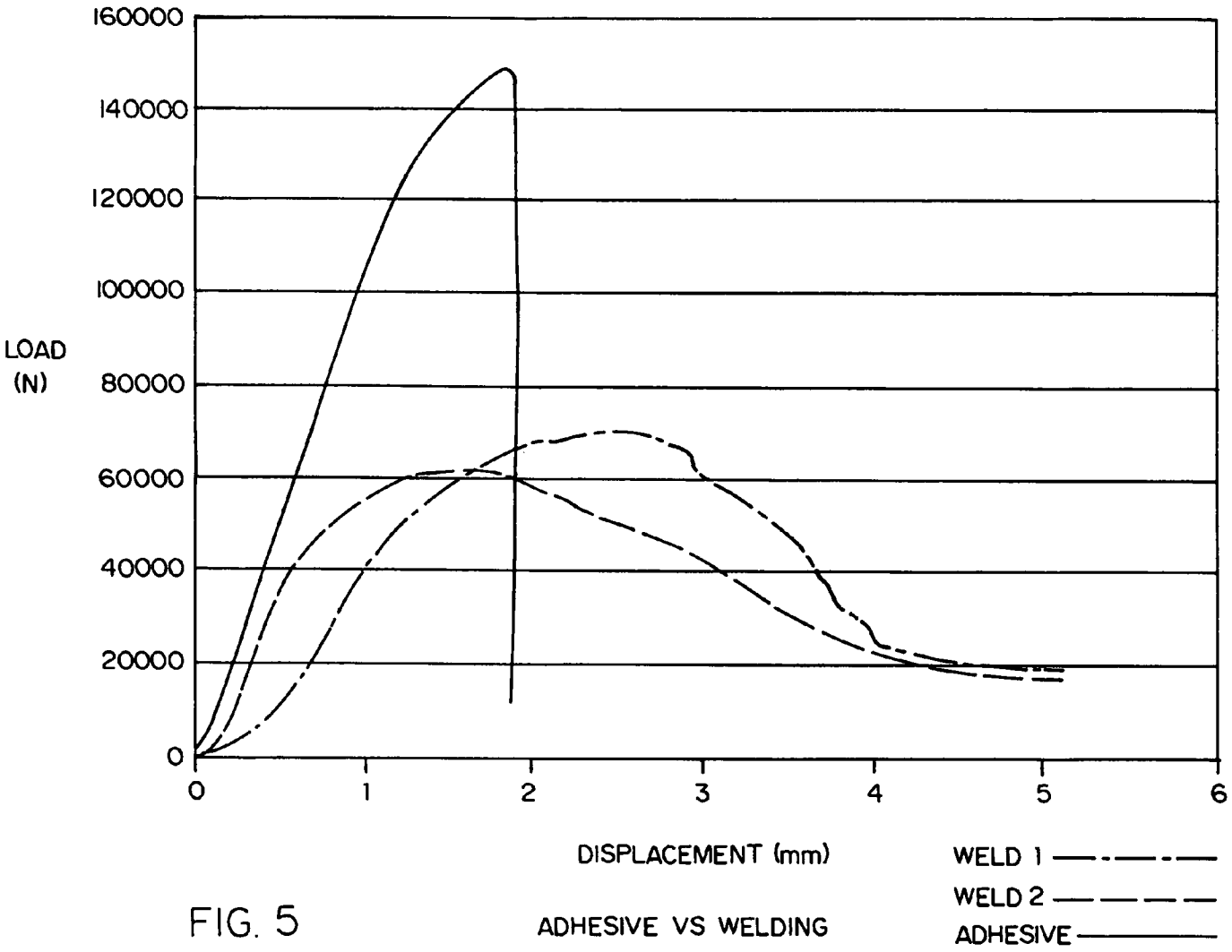
FIG. 5 is a graph comparing load characteristics of test joints made using welding and adhesives.

Finally, FIG. 5 is a graph showing the superior performance of the adhesive interconnection compared to a welded interface. As shown therein, the adhesive interconnection has better than a 2 to 1 performance advantage over welded interconnections.

It will be understood that the invention disclosed herein is not to be limited by the illustrative embodiment described, but only by the appended claims and their legal equivalents.

We claim:

1. An armor blast shield for use on the bottom of a vehicle to protect occupants of the vehicle from improvised explosive devices the blast shield comprising:

at least two planar blast resistant panels and an I-beam having inclined interior walls forming a pair of spaced parallel opposing channels that receive said panels in a V-shaped relation;

each said panel being adhesively affixed to a respective channel of said I-beam and being further secured therein by at least one bolt extending partially through said I-beam and entirely through said panel.

2. The armor blast shield recited in claim 1 wherein said at least two planar blast resistant panels form an obtuse angle relative to one another.

3. The armor blast shield recited in claim 1 wherein said channels are wider than the thickness of the panels by a selected margin for being filled by an adhesive.

4. The armor blast shield recited in claim 3 wherein said selected margin is from 0.02 to 0.03 inches.

5. The armor blast shield recited in claim 1 wherein at least one of said planar blast resistant panels is extended in length from said inclined wall I-beam by affixing a second I-beam and an extension panel to an opposed end of said at least one panel; said second I-beam having non-inclined interior walls.

6. The armor blast shield recited in claim 5 wherein said second I-beam and said extension panel are affixed by adhesive on said non-inclined interior walls and at least one bolt extending through both said second I-beam and said extension panel.

7. A V-shaped armor blast shield for attachment to the hull of a vehicle for resisting damage to the interior of the vehicle from blast energy of an explosion set off below the vehicle; the blast shield comprising:

at least two planar blast resistant panels and an I-beam having inclined interior walls forming a pair of spaced parallel opposing channels that receive said panels in a V-shaped relation;

each said panel being adhesively affixed to a respective channel of said I-beam and being further secured therein by at least one bolt extending partially through said I-beam and entirely through said panel.

8. The armor blast shield recited in claim 7 wherein said at least two planar blast resistant panels form an obtuse angle relative to one another.

9. The armor blast shield recited in claim 7 wherein said channels are wider than the thickness of the panels by a selected margin for being filled by an adhesive.

10. The armor blast shield recited in claim 9 wherein said selected margin is from 0.02 to 0.03 inches.

11. The armor blast shield recited in claim 7 wherein at least one of said planar blast resistant panels is extended in length from said inclined wall I-beam by affixing a second I-beam and an extension panel to an opposed end of said at least one panel; said second I-beam having non-inclined interior walls.

12. The armor blast shield recited in claim 11 wherein said second I-beam and said extension panel are affixed by adhesive on said non-inclined interior walls and at least one bolt extending through both said second I-beam and said extension panel.

13. The armor blast shield recited in claim 12 wherein said bolt extends through a blind hole.

14. The armor blast shield recited in claim 12 wherein said bolt extends through said I-beam from the bottom toward the top of said I-beam.

* * * * *